United States Patent [19]

Vecchiarelli

[11] 4,456,049

[45] Jun. 26, 1984

[54] SPRING BIASED TILT ROD CONTROL SYSTEM

[75] Inventor: Francis Vecchiarelli, River Edge, N.J.

[73] Assignee: Hunter Douglas International N.V., Curacao, Netherlands Antilles

[21] Appl. No.: 404,282

[22] Filed: Aug. 2, 1982

[51] Int. Cl.[3] ..... E06B 9/307

[52] U.S. Cl. ..... 160/176 R; 160/107

[58] Field of Search ..... 160/166, 167, 168, 174, 160/177, 107, 176

[56] References Cited

U.S. PATENT DOCUMENTS 3,326,267 6/1967 Hauck ..... 160/107

FOREIGN PATENT DOCUMENTS 1509407 6/1969 Fed. Rep. of Germany ..... 160/168
402647 5/1966 Switzerland ..... 160/176
1113641 5/1968 United Kingdom ..... 160/107

*Primary Examiner*—Peter M. Caun
*Assistant Examiner*—Cherney S. Lieberman
*Attorney, Agent, or Firm*—Pennie & Edmonds

[57] ABSTRACT

A venetian blind tilt rod control system including a rotatable tilt rod and drive means for rotating the rod. Spring activated connection means operatively connect the drive means and tilt rod and a spring is provided for activating the connection means.

6 Claims, 4 Drawing Figures

SPRING BIASED TILT ROD CONTROL SYSTEM

FIELD OF THE INVENTION

This invention relates to a spring biased venetian blind tilt rod control system and more particularly to a drive connection between a drive means and a tilt rod which may be easily installed in restricted spaces.

BACKGROUND OF THE INVENTION

In some venetian blind constructions, and particularly in constructions for use between spaced glass panes as occurs in double glazed window units and where working space is limited, installation of the parts comprising the blind construction can be difficult and often requires the use of special tools.

In some units the blind construction is assembled with a headrail which includes therein a conventional tilt rod, tape rolls and tape roll supports. The headrail and associated parts are assembled in the window unit after which the tilt rod is connected to a drive means which often comprises a part, such as a miter gear assembly, fixedly mounted in the frame of the window unit. Because of the limited space and because the headrail and miter gear assembly are fixed relative to each other in the frame of the unit, it is difficult to connect the tilt rod drive means to the tilt rod. This may be particularly true if the parts are not in exact alignment.

It has been proposed to include a flexible shaft connection between the tilt rod and miter gear assembly to overcome the difficulties of assembly due to misalignment of the parts but this has not overcome the problems associated with assembly due to the limited working space. Further the flexible shaft in such installations has been fixedly connected to the drive means comprising the miter gear assembly by means of set or locking screws which are difficult to engage with a screw driver due to the limited working area.

It is therefore an object of my invention to provide for a venetian blind tilt rod control system which may be conveniently assembled in restricted spaces without the use of special tools and which does not require any precise alignment between a tilt rod and a tilt rod drive means.

GENERAL DESCRIPTION OF THE INVENTION

Broadly a venetian blind tilt rod control system constructed according to my invention comprises a rotatable tilt rod, mounting means for rotatably and slidably mounting the tilt rod and tilt rod drive means for rotating the tilt rod. Spring activated connection means are provided to operatively connect the drive means with the tilt rod as well as spring means to activate the connection means.

The spring means preferably comprise a coil spring operatively positioned between the tilt rod and the mounting means so as to urge the tilt rod along its longitudinal axis in a direction towards the connecting means. The tilt rod can slide with respect to its mounting means to allow longitudinal movement of the rod.

The connection means preferably includes male and female connection members which are operatively urged into driving engagement with each other by the spring means. The drive means itself may, but not necessarily, comprise a part of a miter gear assembly fixedly mounted with respect to the mounting means. The tilt rod is connected to the drive means by moving the tilt rod against the force of the spring, roughly aligning a connection member urged by the spring means with the other connection member and then allowing the spring urged connection member to be urged into engagement with the other connection member with the engagement being maintained by the spring means. In this matter the need of any set or locking screws and tightening by screw drivers is eliminated.

The invention also contemplates use of a flexible shaft operatively positioned between the tilt rod and drive member to accommodate any misalignment between the two. Preferably the flexible shaft is positioned between the end of the tilt rod and a connection member.

The mounting means for mounting the tilt rod in a headrail preferably comprises conventional tape rolls which are rotatably supported and held against displacement in a longitudinal direction of the headrail by tape roll support means adapted to be fixed to the headrail. The tilt rod is thereby slidably mounted to allow it to move in the headrail. Stop means are included for limiting movement of the rod under the force of the spring means.

The spring means may comprise other springs besides a coil spring and may include either compression or tension springs and the positioning of the spring means in the system may also vary, the only requirement being that it activate the connecting means connecting the tilt rod to the drive means.

DESCRIPTION OF THE PREFERRED MODE

Figure 1:
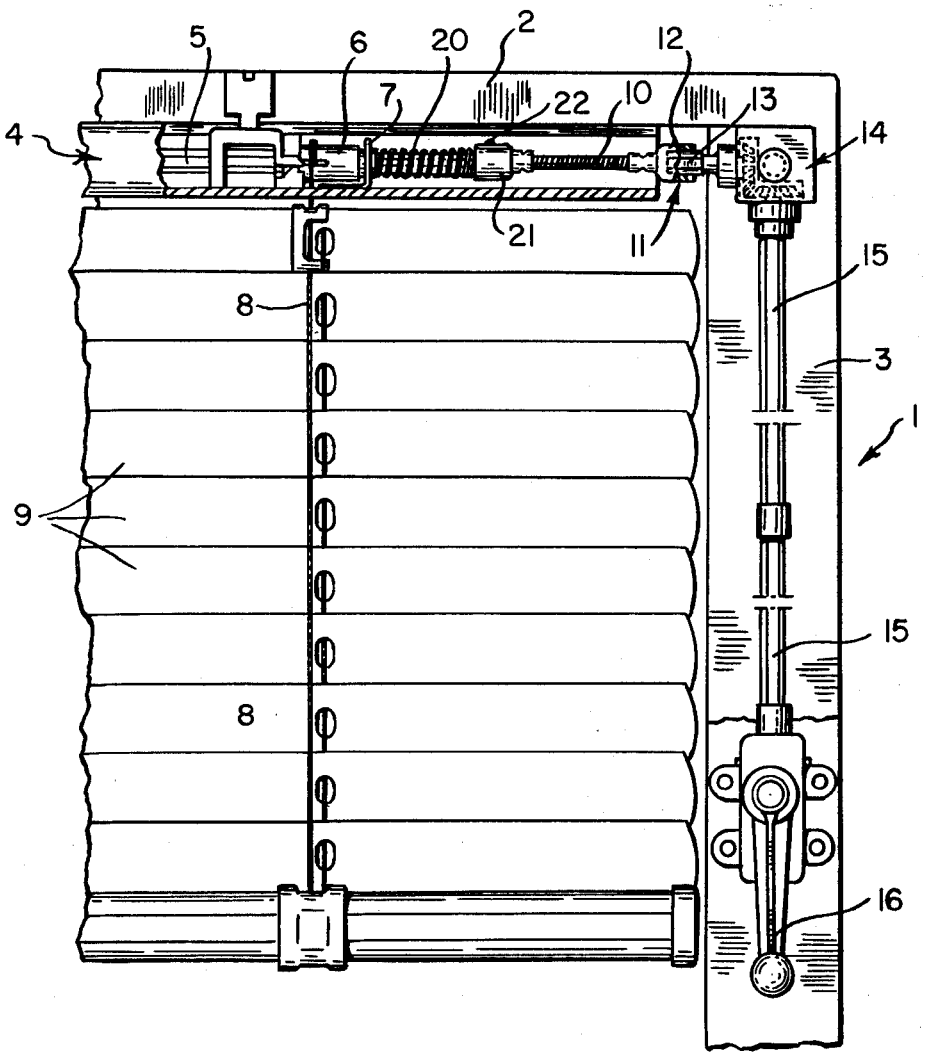
FIG. 1 is a partial broken front view of a tilt rod control system constructed according to the invention installed in a double glazed window unit.
Figure 2:
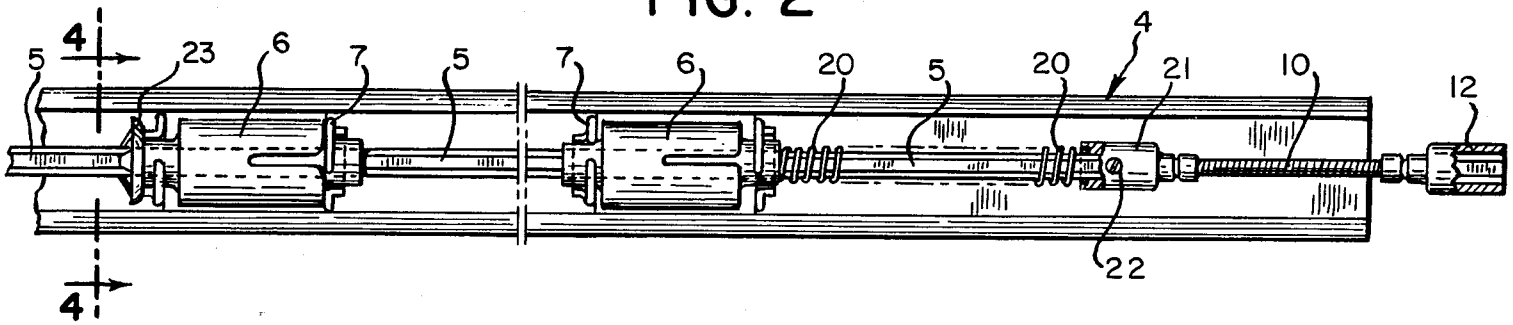
FIG. 2 is an enlarged plan view of a portion of the control system of FIG. 1.

Referring to FIGS. 1 and 2 there is illustrated a double glazed window unit 1 having a hollow top frame member 2 and a hollow side frame member 3. For clarity the glass panes forming the double glazing are not shown. The top frame member has a conventional U-shaped headrail 4 mounted therein and which includes a tilt rod 5, tape roll 6 and tape roll support means 7. Displacement of the tape rolls in the longitudinal direction of the headrail is prevented by the construction of the tape roll supports. The tape rolls have conventional cable means 8 thereon supporting a plurality of slats 9 forming a venetian blind assembly.

The tilt rod 5 has a flexible shaft 10 mounted on the end thereof which joins with a connecting means 11 formed of a female connecting member 12 and a male connecting member 13. Male connecting member 13 in turn joins with a miter gear assembly 14 operatively connected by shaft 15 to a control crank 16 mounted exteriorly of the frame member 3. Miter gear assembly 14, shaft 15 and crank 16 comprise a drive means for rotating the tilt rod to open and close the slats of the blind assembly.

Figure 4:
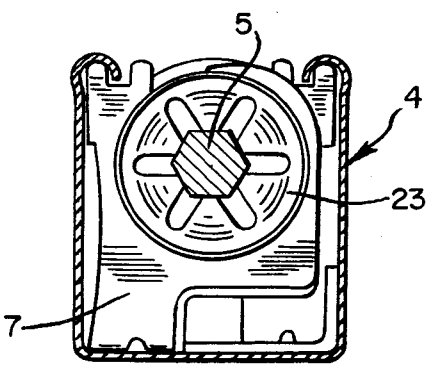
Figure 3:
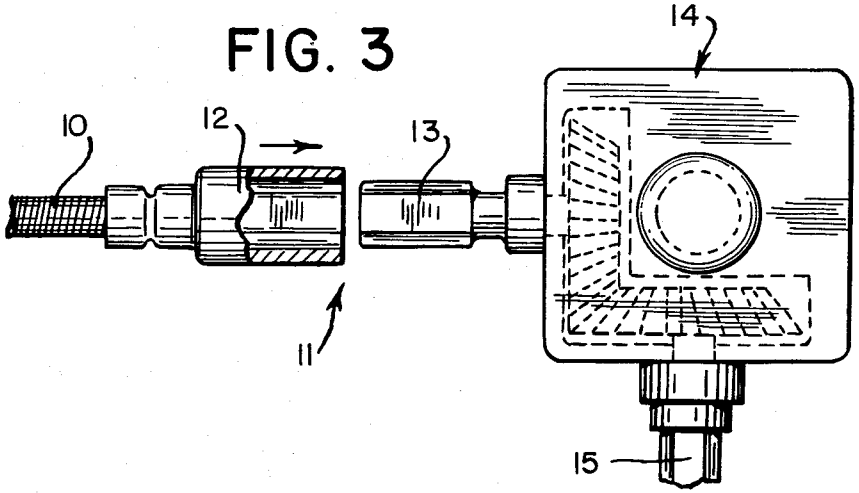
FIG. 3 is an enlarged view of the drive means of FIG. 1 prior to operative connection with the tilt rod; and, FIG. 4 is an enlarged cross-sectional view of FIG. 2 taken along lines 4—4.

As shown in greater detail in FIGS. 2—4, a spring member 20 comprising a compression spring is operatively positioned between a tape roll 6 and a socket member 21 secured to tilt rod 5 by a set screw 22 to urge the tilt rod in a direction towards the right as shown in FIG. 2 outwardly of the headrail 4 and away from the tape rolls 6.

The tape rolls 6 which are held in place by tape roll support means 7 are loosely mounted on the tilt rod so that the tilt rod may move along its longitudinal axis with respect to the tape rolls under the force of the spring member. The tilt rod however does have a hexagonal cross-section as shown in FIG. 4 to cooperate with hexagonal recesses in portions of the tape rolls so that the tilt rod is locked against rotation with respect to the tape rolls.

A locking or stop means 23 in the form of a washer secured to the tilt rod limits movement of the tilt rod under the force of the spring member 20 outwardly of the headrail.

Socket member 21 is fixed to one end of the flexible shaft 10 while the female connection member 12 is fixed to the opposite end of the flexible shaft.

In assemblying the window unit the headrail 4 with attached tape roll support means, tape rolls, tilt rod, spring member and flexible shaft is secured to the frame member 2. The female connection member 12 is then bent about the flexible shaft and moved to the left to reach the position as shown in FIG. 3 in which it is clear from the end of the male connection member 13 included on the miter gear assembly which is fixed in the side frame member. The female connection member is then allowed to move in the direction of the arrow as shown in FIG. 3 so that it surrounds and operatively drivingly engages with the male connection member. The male connection member has a hexagonal cross-section to cooperate with a similar shaped recess in the female connection member so as to prevent relative rotation between the members. This means for eliminating relative rotational movement between the parts along with the spring member assuring longitudinal connection between the parts eliminates any need of a set screw to assure permanent operative connection between the members.

As seen by reference to FIG. 1 the working space available at the connection means 11 in which to manipulate a screw driver or other tool is extremely limited such that the elimination of need of a set screw is an important feature.

While the female connection member 12 is shown connected to the end of the flexible shaft, it could be reversed with that of the male member 13, that is male member 13 could be connected to the shaft 10 and the female member could be connected with the miter gear assembly 14.

Further while the flexible shaft provides a desirable feature in that it eliminates need to provide a precise alignment between the tilt rod and miter gear assembly, it is not absolutely necessary in providing the structure resulting in easy connection of the drive means to the tilt rod in restricted spaces. Thus if the flexible shaft were eliminated and the tilt rod were in general alignment with the drive means, a connection member could be mounted directly on the end of the tilt rod for engagement with a connection member mounted on the drive means. The spring member would continue to provide the force for operatively connecting the female and male members together.

I claim:

1. A spring biased venetian blind tilt rod control system comprising a rotatable tilt rod, mounting means for mounting said tilt rod for rotational movement, tilt rod drive means for rotating said tilt rod, spring activated connection means adapted to operatively connect said drive means with said tilt rod and being displaceable with respect to said mounting means in a direction lengthwise of the tilt rod axis, spring means for urging said spring activated connection means to operatively connect said drive means and said tilt rod, wherein said spring means are operatively positioned between said mounting means and said connection means, and stop means for limiting the displacement of said connection means under the effect of said spring means.

2. A spring biased venetian blind tilt rod control system according to claim 1 wherein said connection means includes a male connection member and a female connection member operatively urged into driving engagement with each other by said spring means.

3. A spring biased venetian blind tilt rod control system according to claim 2 wherein said connection means includes in addition a flexible shaft member operatively positioned between said tilt rod and said drive member.

4. A spring biased venetian blind tilt rod control system according to claim 3 wherein said drive means comprises a miter gear assembly fixed with respect to said mounting means.

5. A spring biased venetian blind tilt rod control system according to claim 3 wherein said flexible shaft member is operatively positioned between said tilt rod and a connection member.

6. A spring biased venetian blind tilt rod control system according to claim 1 wherein said mounting means comprises a tape roll movable longitudinally with respect to said tilt rod, and a tape roll support means adapted to be fixed to a headrail for rotatably supporting said tape roll.

* * * * *